US006396459B1

(12) United States Patent
Pullman

(10) Patent No.: US 6,396,459 B1
(45) Date of Patent: May 28, 2002

(54) EASY TRIM DISH MOUNT

(76) Inventor: Timothy A. Pullman, 420 W 1st Ave., Miller, SD (US) 57362

( * ) Notice: Subject to any disclaimer, the term of this patent is extended or adjusted under 35 U.S.C. 154(b) by 0 days.

(21) Appl. No.: 09/880,226

(22) Filed: Jun. 14, 2001

(51) Int. Cl.[7] ..... H01Q 1/12
(52) U.S. Cl. ..... 343/878; 343/890
(58) Field of Search ..... 343/840, 878, 343/880, 881, 882, 883, 890, 892; 52/27; 248/148, 235, 237

(56) References Cited

U.S. PATENT DOCUMENTS 4,249,185 A 2/1981 DeCesari ..... 343/871
4,295,143 A * 10/1981 Winegard et al. ..... 343/840
5,154,027 A 10/1992 Warden ..... 52/108
5,456,433 A * 10/1995 Burns et al. ..... 248/148
5,617,680 A * 4/1997 Beatty ..... 52/27
6,018,325 A 1/2000 Lundgren ..... 343/890
6,037,913 A 3/2000 Johnson ..... 343/882

* cited by examiner

*Primary Examiner*—Tan Ho
(74) *Attorney, Agent, or Firm*—Patent & Trademark Services; Thomas Zack; Joseph H. McGlynn

(57) ABSTRACT

A system for trimming out the base plate of a satellite dish mount when siding or residing a wall where the satellite is mounted, comprising a two part base and trim ring that snaps onto the base.

6 Claims, 5 Drawing Sheets

EASY TRIM DISH MOUNT

BACKGROUND OF THE INVENTION

This invention relates to a system for trimming out the base plate of a satellite dish mount when siding or residing a wall where the satellite is mounted.

Mounts for satellite dishes and the like are well known and have been used for many years. When a satellite dish is normally mounted to the side of building with siding, such as aluminum, vinyl or a composite material siding, the siding needs to be trimmed and removed from the area where the base plate for mounting the dish is to be mounted on the building. This is a time consuming affair and initially requires trimming an outline for base plate, removing the sliding material within the confines of the outline and then mounting plate and satellite dish to the wall. A custom made trim may extend around the opening cut in the siding to both assist in retaining the base plate to the wall and to provide an aesthetic look for the mount.

It would be very desirable to provide for a dish mounting system which could be used with many different types of existing or new vertical siding of a building, when the siding has different thickness and is made of different materials. Also, it is important that the mounting system be easy to use, installed in a short time and not disrupt unnecessarily any existing structure to save on time, labor and money for both the buyer and installer. Another desirable feature is that such the mounting system used not normally require the satellite dish to be realigned with the broadcast satellite.

In one prior art invention there is disclosed a portable supporting structure for a quad antenna with a horizontal telescopic boom upon which are mounted several sets of folding spreader arms radiating from the boom.

Another system discloses a retractable mast which can be rotated when deployed using one drive for three functions.

In another system an antenna mounting system with a pole secured at one end, and a platform connected to the pole by a rotatable tiltable joint is disclosed.

Still another invention discloses a mount for a satellite dish antenna which includes a base mountable to a wall, an extension arm that pivots about the base and telescopes in length and an aiming system attached to the end of the extension arm for mounting the antenna.

DESCRIPTION OF THE PRIOR ART

Antenna mounting systems and devices are disclosed in the known in the prior art. For example, U.S. Pat. No. 4,249,185 to DeCesari discloses a portable supporting structure for a quad antenna with a horizontal telescopic boom upon which are mounted several sets of folding spreader arms radiating from the boom.

U.S. Pat. No. 5,154,027 to Warden discloses a retractable mast which can be rotated when deployed using one drive for three functions.

U.S. Pat. No. 6,018,325 to Lundgren discloses an antenna mounting system with a pole secured at one end, and a platform connected to the pole by a rotatable tiltable joint is disclosed.

U.S. Pat. No. 6,037,913 to Johnson discloses a mount for a satellite dish antenna which includes a base mountable to a wall, an extension arm that pivots about the base and telescopes in length and an aiming system attached to the end of the extension arm for mounting the antenna.

The present invention is a system for trimming out the base plate of a satellite dish mount when siding or residing a wall where the satellite is mounted, comprising a two part base and trim ring that snaps onto the base plate all as will be detailed in the specification that follows hereafter.

SUMMARY OF THE INVENTION

This invention relates to a system for trimming out the base plate of a satellite dish mount when siding or residing a wall where the satellite is mounted, comprising a two part base and trim ring that snaps onto the base.

It is the primary object of the present invention to provide for an improved satellite dish mount system.

Another object is to provide for such a system in which there is a two part base plate and a two part trim ring which is fitted into the base plate.

These and other objects and advantages of the present invention will become apparent to readers from a consideration of the ensuing description and the accompanying drawings.

DESCRIPTION OF THE PREFERRED EMBODIMENT

Figure 1:
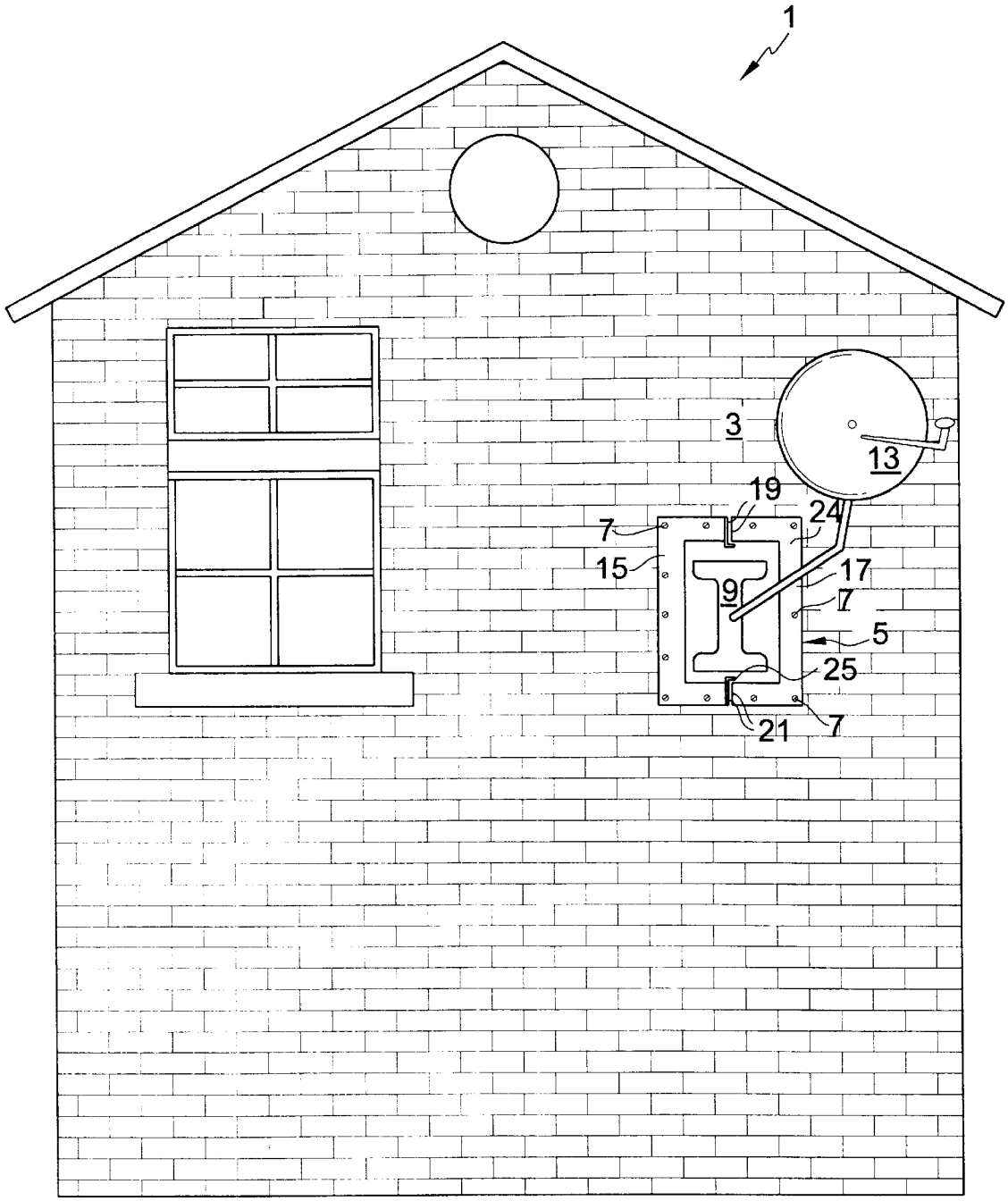
FIG. 1 is a perspective schematic view showing a dished attached to a building wall.

FIG. 1 is a perspective schematic view showing a dished attached to a building 1 having vertical disposed and horizontally extending siding strips 3. A rectangular outlined base plate 5 is mounted in a cut out portion with the same configuration, where the siding has been removed, and is fixed to the side of the wall of the building 1. Mounting screws 7 extend into each of the spaced holes in the base plate 5 and into the underlying wall's conventional backing material such as plywood, backboard, etc. to retain the base plate to the side wall. Extending from the center conventional satellite dish base 9 is a pole 11 which supports a conventional satellite dish 13 from the building in an upward direction.

The base plate 5 is constructed of two mating pieces 15 and 17. These two pieces meet at their two joining upper and lower mating edges 19 and 21. Within the inner perimeter of the plate 5 are two edge extensions 23 and 25 on the plate piece or segment 15, one on the top and one on the bottom of this piece. These two extensions extends across the gaps formed between the mating edges 19 and 21.

Figure 2:
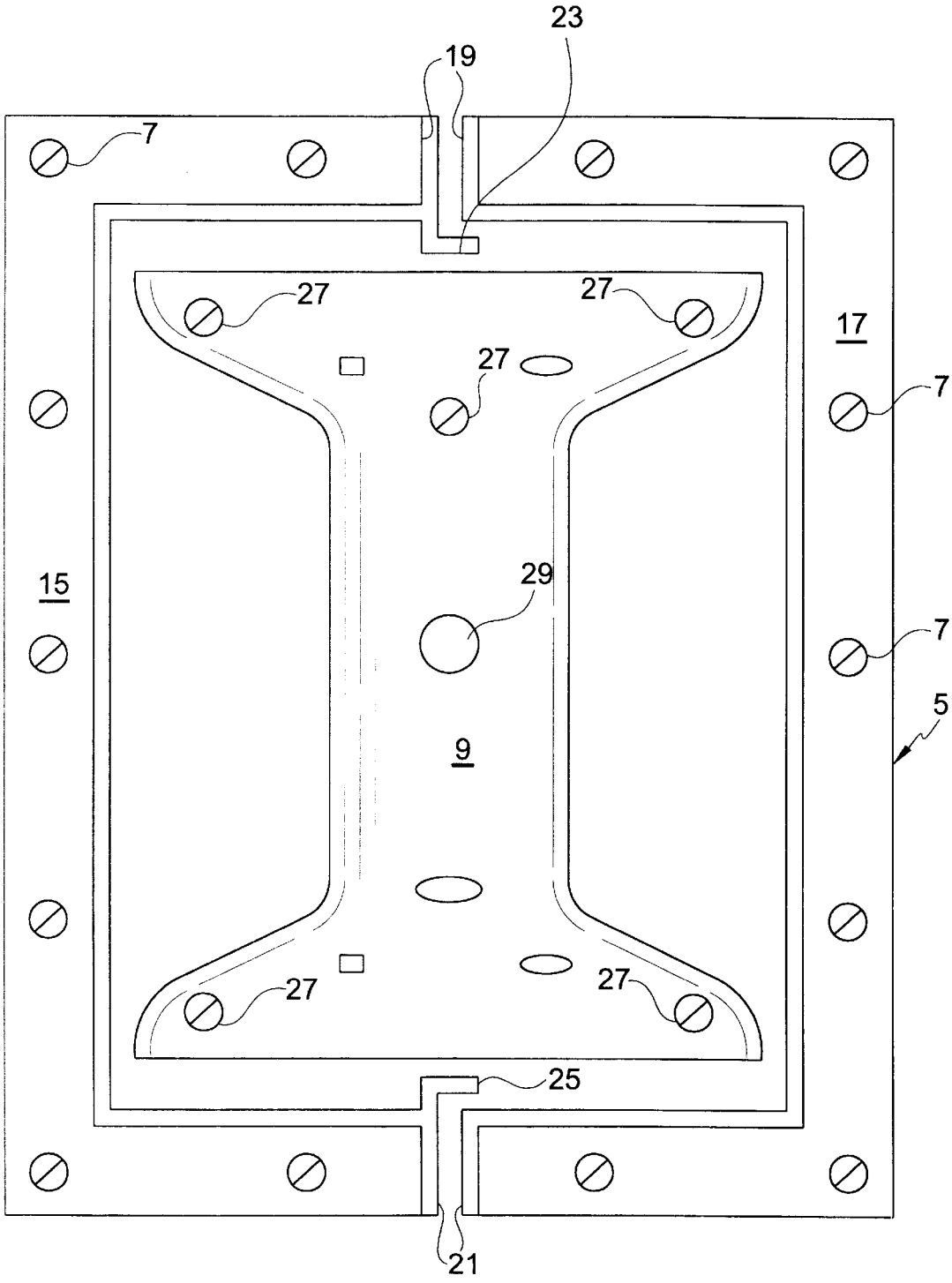
FIG. 2 is a front view showing the base plate for the satellite dish and the trim base plate mount.

FIG. 2 is an enlarged front view showing a conventional satellite base plate 9 for the satellite pole and dish, shown previously, and the easy trim base plate split mount 5. The two extensions for the base piece 15 are more clearly shown in this second figure. The conventional satellite dish base 9 is located within the confines of the outline formed by the two pieces 15 and 17 of outer base mount 5. Screws or other fasteners 27 retain the base plate 9 to the existing building material forming the building wall on which mounted.

Appropriate openings in plate 9 permit a cable to extend into the building may also be provided. An larger opening 29 in the base plate 9 acts as the support for the end of the dish support pole 11, shown in FIG. 1, but not shown here. The hole 29 may have internal threads to engage external threads on the pole or the underlying plate 9 may be fasten the pole in some other manner.

Figure 3:
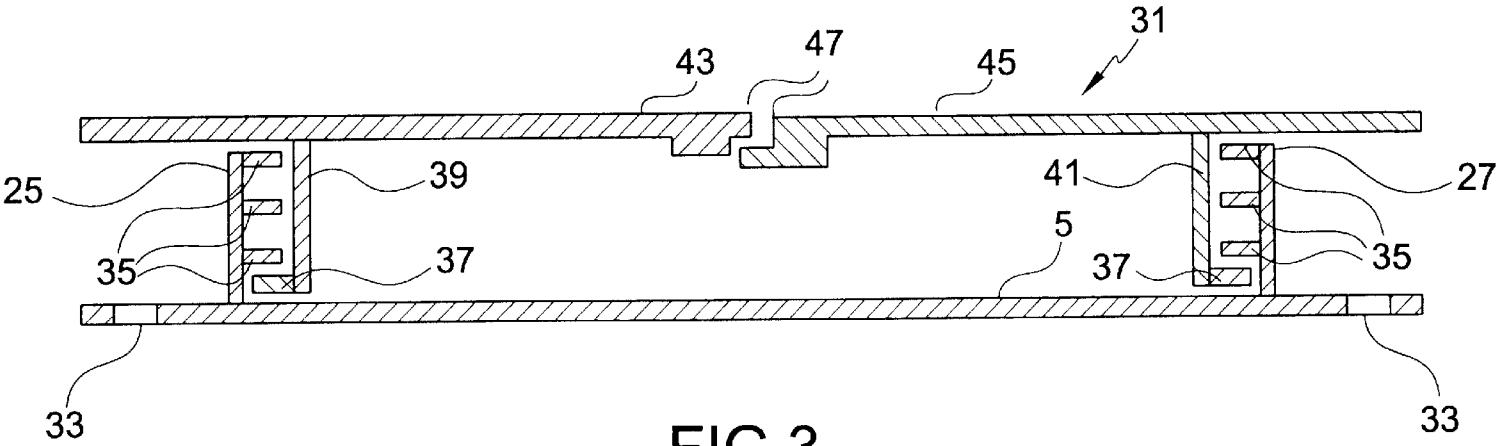
FIG. 3 is a side cross sectional view of the base plate and trim ring.
Figure 4:
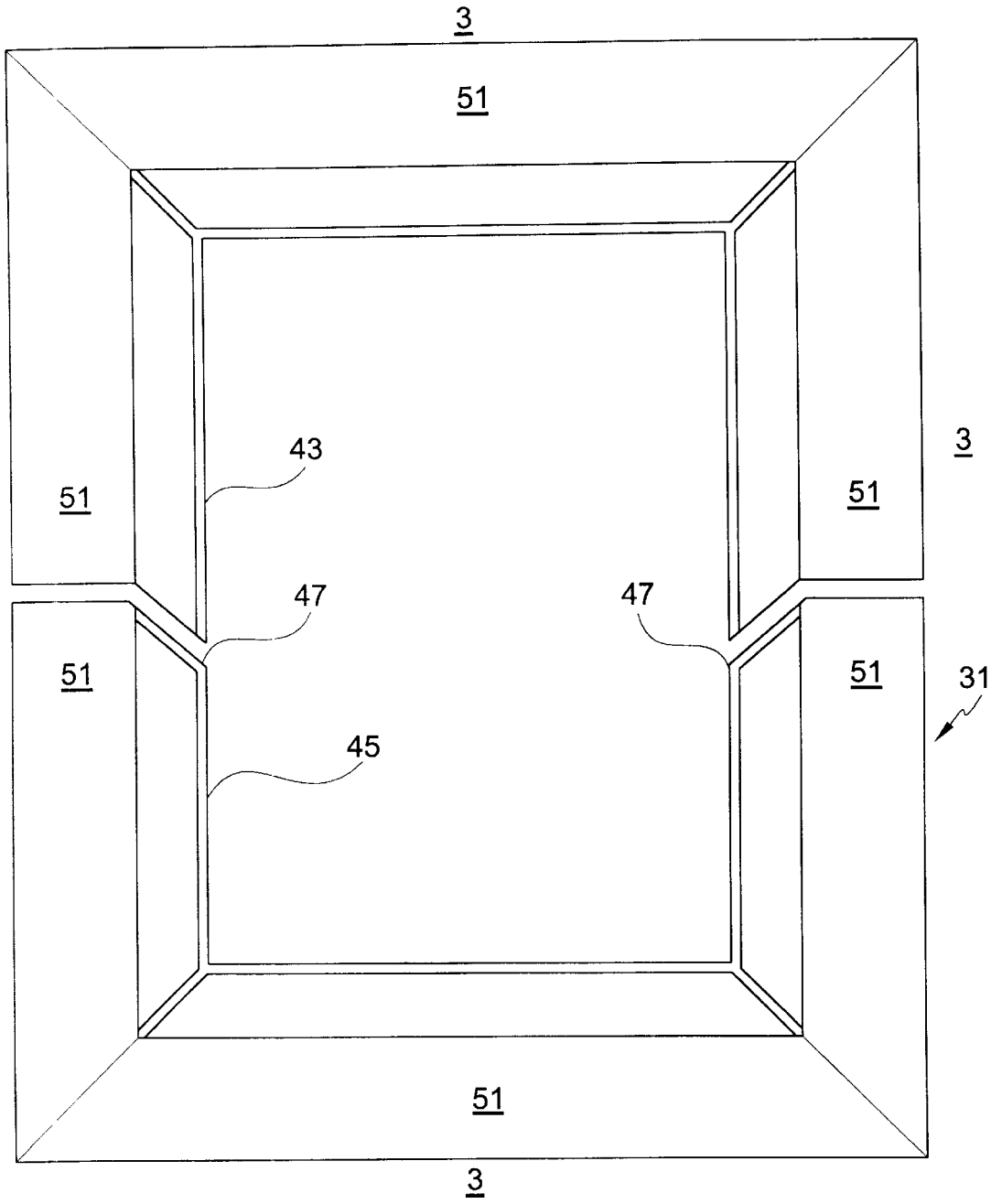
FIG. 4 is a front view of the two piece trim ring.

FIG. 3 is a side cross sectional view of the two piece base plate 5 and the covering trim ring 31 shown in FIG. 4. The cover trim ring 31 fits over the base plate and is also composed of two pieces. In this view the holes 33 for the base plate screws 7 are shown. Extending upwardly from the base plate and towards the ring 31 are two vertical extensions 25 and 27. Each extension has three spaced tab dividers 35. The volume between the dividers acts as a retainer opening for a tab 37 fixed to each of the spaced extensions 39 and 41 fixed to trim ring 31. In this way the trim ring an accommodate siding of three different thickness and may be snap fit into the base plate 5 at its retainer opening. The two pieces of the trim ring 43 and 45 overlap each other at their mating edges 47 with overlapping upper and lower extensions, as shown. This overlapping of edges on trim ring pieces allows for the accommodate of different sizes of base plates and their cut outs in the siding.

FIG. 4 is a front view of the two piece trim ring 31 shown in FIG. 3. The trim ring resembles a picture frame in appearance and is snap fit on the wall supported base plate 5 which is covers. The inner conventional base 9 support for the satellite pole or the pole and dish are not shown in this figure. Overlapping outer edges 51 of the ring 31 fit over adjacent edges of siding 3 near the cut out portion previously provide and used to receive the satellite dish mount 9 and plate 5. The two meeting edges 47 of the two trim ring pieces 43 and 45 are depicted just before they would overlap and abut each other. The two lower inwardly facing extensions 39 and 41, which face towards the plate 5 two for each ring piece 43 and 45, are beneath them and therefore not visible as is the covered wall mounted plate 5.

Figure 5:
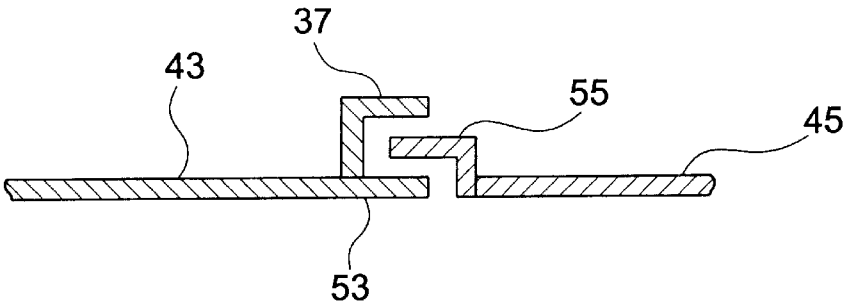
FIG. 5 shown a slightly different embodiment for the overlap of the meeting edges of the trim ring cover shown in FIG. 3.

FIG. 5 shows a slightly different configuration for the meeting edges on the two piece trim cover ring 31 to provide for their overlapping edges. In this configuration the outer or visible edge 53 of piece 43 abuts into an outer edge of piece 45. Rather than having an inner groove in edge 53 to receive the offset protrusion 55 of piece 45, as in FIG. 3, there is a right angled extension 57 on trim ring piece 43.

Figure 6:
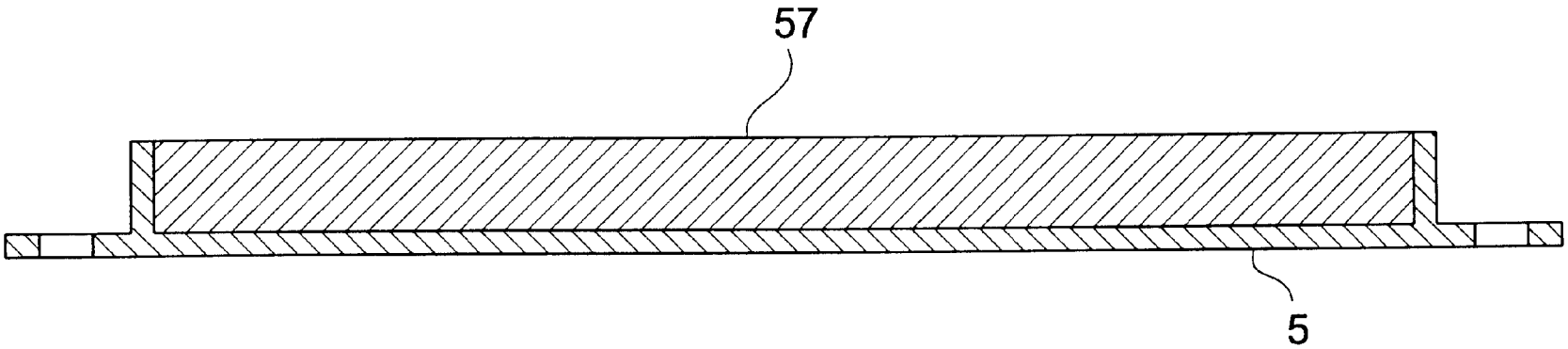
FIG. 6 is a side view of the base plate and an apparatus used to trim out the base plate on siding.

FIG. 6 is a side view of the base plate 5 and a conventional apparatus 57 used to trim out the siding to permit installation of the base plates 5 and the conventional satellite plate 9. Apparatus 57 may be a miter saw blade fixed to cut a specific depth into the siding material and removed the four sides of the rectangular cut out.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A satellite dish mount system comprising:

a plate for mounting a satellite dish to the side wall of a building having covering siding;

a cut out formed in the siding of the wall, said cut out having a base plate extending around the perimeter of the cut out and fixed to the wall of the building;

an external ring trim member adapted to fit over said base plate and having two interfacing pieces mounted to the base plate; and said trim ring member having two pieces that engage mating members on the base plate and having overlapping side edges.

2. The satellite dish mount system as claimed in claim 1, wherein the trim ring member is adjustably mounted to the base plate to permit the adjust relative to the base plate and siding having different thicknesses.

3. The satellite dish mount system as claimed in claim 2, wherein the base plate consists of two pieces with abutting edges.

4. The satellite dish mount system as claimed in claim 3, wherein said trim ring includes an extension facing towards the base plate and snap fit into retaining openings mounted to the base plate.

5. The satellite dish mount system as claimed in claim 4, wherein base plate has extensions extending towards the trim ring, each of said extensions having dividers to from retaining openings to receive a trim ring extension.

6. The satellite dish mount system as claimed in claim 5, wherein said trim ring has outer side and top extensions which overlapping adjacent portions of the siding near the cut out.

* * * * *